US009198498B2

(12) United States Patent
Stevens, IV

(10) Patent No.: US 9,198,498 B2
(45) Date of Patent: Dec. 1, 2015

(54) APPARATUS FOR REMOVABLY CONTAINING MULTIPLE HANDHELD DEVICES

(71) Applicant: Nathaniel D. Stevens, IV, Chula Vista, CA (US)

(72) Inventor: Nathaniel D. Stevens, IV, Chula Vista, CA (US)

( * ) Notice: Subject to any disclaimer, the term of this patent is extended or adjusted under 35 U.S.C. 154(b) by 125 days.

(21) Appl. No.: 14/187,089

(22) Filed: Feb. 21, 2014

(65) Prior Publication Data

US 2015/0237998 A1 Aug. 27, 2015

(51) Int. Cl.
*A45C 1/04* (2006.01)
*A45F 5/02* (2006.01)
*F41C 33/02* (2006.01)

(52) U.S. Cl.
CPC ..... *A45F 5/021* (2013.01); *F41C 33/0209* (2013.01)

(58) Field of Classification Search
CPC ..... A45C 1/06; A45C 1/04; A45C 2003/005; A45C 3/06; A45C 3/08; A45F 5/022; A45F 5/021
USPC ..... 224/587, 665, 236, 238, 904
See application file for complete search history.

(56) References Cited

U.S. PATENT DOCUMENTS 3,147,896 A * 9/1964 Kehl ..... 224/240
6,659,321 B2 * 12/2003 Hartranft et al. ..... 224/683
7,661,566 B2 * 2/2010 Yoshie et al. ..... 224/159

* cited by examiner

*Primary Examiner* — Adam Waggenspack
(74) *Attorney, Agent, or Firm* — GSS Law Group

(57) ABSTRACT

An apparatus for containing multiple handheld devices includes a first compartment dimensioned to removably store a first device and a second compartment dimensioned to removably store a second device. The back portion of the second compartment is attached to the back portion of the first compartment by a flexible portion spanning a distance between the first compartment and the second compartment and the flexible portion includes a first attachment mechanism positioned between the first compartment and the second compartment. A front flap extends from the front portion of the first compartment, the front flap to removably overlap the opening of the first compartment and the opening of the second compartment and the front flap including a second attachment mechanism to removably attach to the first attachment mechanism of the flexible portion.

20 Claims, 5 Drawing Sheets

APPARATUS FOR REMOVABLY CONTAINING MULTIPLE HANDHELD DEVICES

BACKGROUND OF INVENTION

Traditionally, a law enforcement officers or combat personnel may carry a handheld firearm in a holster that is positioned in a concealed location on the body of the user. Additionally, individuals possessing a concealed carry weapon (CCW) permit may carry a handheld firearm in public if the handheld firearm is carried in a concealed manner on the body of the user, such as in a holster. Commonly, the holster is tucked inside the waistband of the user's clothing and secured by a connecting clip to an article of the user's clothing, such as a belt.

In recent years, in addition to a handheld firearm, most law enforcement officers, combat personnel and individuals possessing CCW permits also need to be able carry a handheld portable communication device, such as a cellular telephone or personal digital assistant (PDA). The portable communication device is traditionally carried in a case that is separate from the holster and that is also secured to an article of the user's clothing by a connecting clip.

As such, it is necessary for a law enforcement officer, combat personnel or individual possessing a CCW permit to carry both a handheld firearm holster and a cellular telephone case secured to their waistband. Carrying multiple devices is cumbersome. Additionally, due to the connecting clips it is not physically possible to position both the handheld firearm holster and the cellular telephone case in a location on the user that would be considered optimum for the handheld devices.

Accordingly, what is needed in the art is an apparatus capable of containing multiple handheld devices, such as a handheld firearm and a cellular telephone, and capable of being secured to a user by a common connecting clip.

SUMMARY OF THE INVENTION

In accordance with the present invention is provided an apparatus for removably containing one or more handheld devices, such as a handheld firearm and a cellular telephone.

In one embodiment, the apparatus includes a first compartment dimensioned to removably store a first device, the first compartment having opposing front and back portions, opposing side portions and a top portion opening to receive the first device. The apparatus further includes, a second compartment dimensioned to removably store a second device, the second compartment having a bottom portion, opposing front and back portions, opposing side portions and a top portion opening to receive the second device. The back portion of the second compartment is attached to the back portion of the first compartment by a flexible portion spanning a distance between the first compartment and the second compartment, the flexible portion including a first attachment mechanism positioned between the first compartment and the second compartment. The apparatus further includes a front flap extending from the front portion of the first compartment, the front flap to removably overlap the opening of the first compartment and the opening of the second compartment and the front flap including a second attachment mechanism to removably attach to the first attachment mechanism of the flexible portion.

The apparatus may further include a third attachment mechanism positioned on the front portion of the second compartment and the front flap may further include a fourth attachment mechanism to removably attach the front flap to the front portion of the second compartment.

The apparatus may further include a first apparatus attachment device positioned on the back portion of the first compartment and configured to allow the apparatus to be attached to a wearable article. In a specific embodiment, the wearable article is a belt.

The apparatus may further include a fifth attachment mechanism positioned on the back portion of the first compartment. In one embodiment, the first apparatus attachment device may include a back flap integral with, and extending from, the front portion of the first compartment, the back flap to form a bottom portion of the first compartment and the back flap having a sixth attachment mechanism to removably attach the back flap to the fifth attachment mechanism of the first compartment.

The apparatus may further include a second apparatus attachment device positioned on the back portion of the second compartment and configured to allow the apparatus to be attached to a wearable article. In a specific embodiment, wearable article may be a belt and the second apparatus attachment device may be a belt clip.

In a specific embodiment, one or more of the attachment mechanisms of the apparatus may be hook-and-loop fasteners.

As such, the apparatus of the present invention is capable of containing multiple handheld devices, such as a handheld firearm and a cellular telephone and is capable of being secured to a user by a common apparatus attachment device. The apparatus additionally provides independent accessibility to the multiple handheld devices.

BRIEF DESCRIPTION OF THE DRAWINGS

Accompanying drawings show one or more embodiments; however, the accompanying drawings should not be taken to limit the invention to only the embodiments shown. Various aspects and advantages will become apparent upon review of the following detailed description and upon reference to the drawings in which.

DETAILED DESCRIPTION OF THE INVENTION

Figure 1:
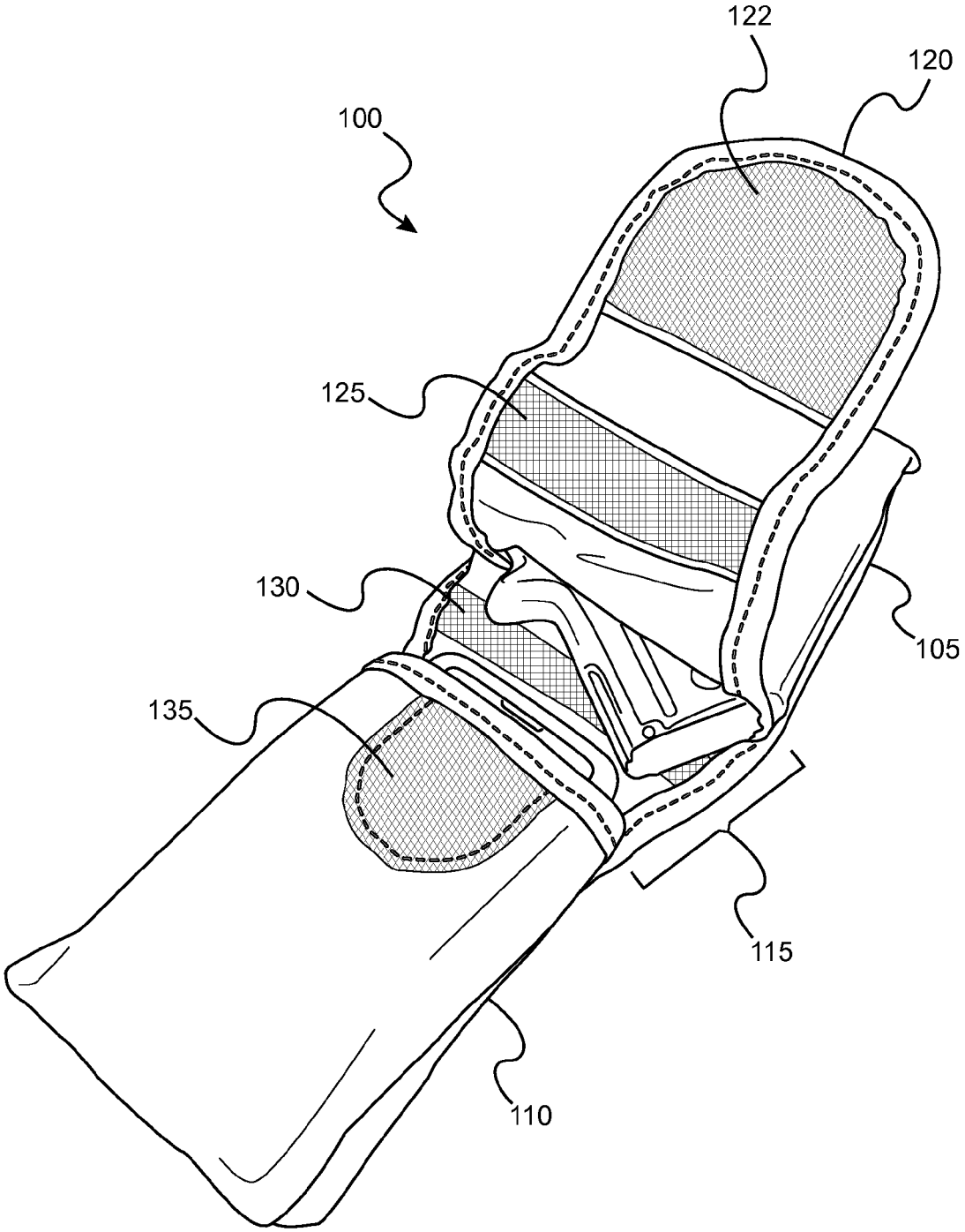
FIG. 1 is a diagram illustrating a front view of the apparatus for containing multiple handheld devices with the front flap in an open position, in accordance with an embodiment of the present invention.

Those of ordinary skill in the art will realize that the following detailed description of embodiments in this specification is illustrative only, and is not intended to be in any way limiting. Other embodiments will readily suggest themselves to such skilled persons having the benefit of this disclosure. It will be apparent to one skilled in the art that these specific details may not be required to practice the embodiments. In the following description of the embodiments, substantially the same parts are denoted by the same reference numerals.

Generally, the present invention provides an apparatus for containing multiple handheld devices that can be secured to wearable article of user.

With reference to FIG. 1, an apparatus for containing multiple handheld devices 100 includes a first compartment 105 dimensioned to removably store a first device, the first compartment 105 having opposing front and back portions, opposing side portions and a top portion opening to receive the first device. The first compartment 105 may be constructed of a flexible or non-flexible material. In one embodiment, the first compartment 105 may be constructed of a flexible nylon-based material.

The apparatus 100 further includes a second compartment 110 dimensioned to removably store a second device, the second compartment 110 having a bottom portion, opposing front and back portions, opposing side portions and a top portion opening to receive the second device. The second compartment 110 may be constructed of a flexible or non-flexible material. In one embodiment, the second compartment 105 may be constructed of a flexible nylon-based material.

To couple the first compartment 105 to the second compartment 110, a back portion of the second compartment 110 is attached to the back portion of the first compartment 105 by a flexible portion 115 spanning a distance between the first compartment 105 and the second compartment 110. The flexible portion 115 may be contiguous with the back portion of the second compartment 110 and the back portion of the first compartment 105. Alternatively, the flexible portion 115 may be independent attached, such as by sewing, the flexible portion 115 to the back portion of the second compartment 110 and the back portion of the first compartment 105. In one embodiment, the flexible portion 115 may be constructed of a flexible nylon-based material.

Figure 2:
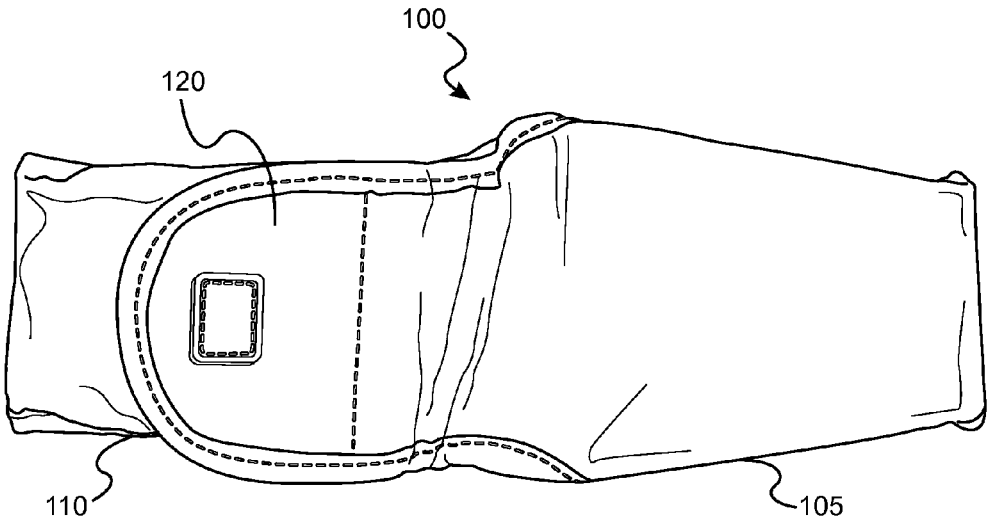
FIG. 2 is a diagram illustrating a front view of the apparatus for containing multiple handheld devices with the front flap in a closed position, in accordance with an embodiment of the present invention.

To secure the multiple devices in the compartments and to conceal the top portion openings of the compartments, the present invention further includes a front flap 120 extending from the front portion of the first compartment 105 to secure and conceal the multiple devices when the front flap 120 is in the closed position as shown in FIG. 2. To secure a device within the first compartment 110, the flexible portion 115 is secured to the front flap 120. To secure the flexible portion 115 to the front flap 120, the flexible portion 115 includes a first attachment mechanism 130 positioned between the first compartment 105 and the second compartment 110 and the front flap 120 includes a second attachment mechanism 125. The second attachment mechanism 125 is positioned on a lower portion of the front flap and is positioned to face the top portion of the second compartment 110 when the front flap is in the closed position. When the front flap 120 and is in the closed position, the first attachment mechanism 130 and the second attachment mechanism 125 are in contact to secure a handheld device within the first compartment 105 and to conceal the top opening of the first compartment 105.

In one embodiment, the first attachment mechanism 130 and the second attachment mechanism 125 may form a hook-and-loop fastener, more commonly known as Velcro®. In forming the hook-and-loop fastener, one of either the first attachment mechanism 130 or the second attachment mechanism 125 may be comprised of a plurality of plastic hooks and the other of the first attachment mechanism 130 or the second attachment mechanism 125 may be comprised of a plurality plastic loops, such that when the first attachment mechanism 130 and the second attachment mechanism 125 are in contact, they form a hook-and-loop fastener that secures the front flap 120 to the flexible portion 115. Alternatively, the first attachment mechanism 130 and the second attachment mechanism 125 may form a magnetic fastener or a physical fastener, such as a snap or latch, or any of a variety of other fastening means which are commonly known in the art.

The front flap 120 is additionally used to secure and conceal a device in the second compartment 110 when the front flap 120 is in the closed position as shown in FIG. 2. To secure a device within the second compartment 110, the flexible portion 115 is secured to the front flap 120. To secure the flexible portion 115 to the front flap 120, apparatus further includes a third attachment mechanism 135 positioned on the front portion of the second compartment 110 and the front flap further 120 further includes a fourth attachment mechanism 122 to removably attach the front flap 120 to the front portion of the second compartment 110. In one embodiment, the third attachment mechanism 135 is positioned on the front flat 120 distal to the top opening of the first compartment 105 and the fourth attachment mechanism 122 is positioned on the front portion of the second compartment 110 and proximate to the top opening of the second compartment. When the front flap 120 and is in the closed position, the third attachment mechanism 135 and the second attachment mechanism 122 are in contact to secure a handheld device within the first compartment 105 and to conceal the top opening of the first compartment 105.

In one embodiment, the third attachment mechanism 135 and the fourth attachment mechanism 122 may form a hook-and-loop fastener, more commonly known as Velcro®. In forming the hook-and-loop fastener, one of either the third attachment mechanism 135 or the fourth attachment mechanism 122 may be comprised of a plurality of plastic hooks and the other of the third attachment mechanism 125 or the fourth attachment mechanism 122 may be comprised of a plurality plastic loops, such that when the third attachment mechanism 135 and the fourth attachment mechanism 122 are in contact, they form a hook-and-loop fastener that secures the front flap 120 to the flexible portion 115. Alternatively, the third attachment mechanism 135 and the fourth attachment mechanism 122 may form a magnetic fastener or a physical fastener, such as a snap or latch, or any of a variety of other fastening means which are commonly known in the art.

In a particular embodiment, the first device may be a handheld firearm removably stored in the first compartment 105 and the second device may be a portable communication device, such as a cellular telephone or a personal digital assistant removably stored in the second compartment 110 of the apparatus. The front flap 120 is removable secured to the first compartment 105 using the first attachment mechanism second compartment 110 using the third attachment mechanism 135 of the second compartment 110 and the fourth attachment mechanism 122 of the front flap 120.

The multiple attachment mechanisms of the apparatus 100 allows for the selective removal of the individual handheld devices. As shown with reference to FIG. 2, when the apparatus 100 is completely closed, the opening of both the first compartment 105 and the second compartment 110 are concealed by the front flap 120. In the closed configuration, the second attachment mechanism 125 of the front flap 120 is secured to the first attachment mechanism 130 of the flexible extension 115 and the fourth attachment mechanism 122 of the front flap 120 is secured to the third attachment mechanism 135 of the second compartment 110.

The apparatus of the present invention enables a user to remove a handheld device from the second compartment 110 by detaching the third attachment mechanism 135 on the second compartment 110 from the fourth attachment mechanism 122 on the front flat 120 without detaching the first attachment mechanism 130 of the flexible extension 115 from the second attachment mechanism 125 of the front flap 120. Buy only detaching the third attachment mechanism 135 from the fourth attachment mechanism 122, the user is able to access the handheld device in the second compartment 110 while keep the handheld device in the first compartment 105 secured and concealed. To detach the third attachment mechanism 135 from the fourth attachment mechanism 122, the user pulls the front flap 120 in an upward direction toward the top opening of the second compartment 110 with sufficient force to detach the third attachment mechanism 135 from the fourth attachment mechanism 122 but with insufficient force to detach the first attachment mechanism 130 from the second attachment mechanism 125. In this way, the handheld device in the second compartment 110 is accessible to the user and the handheld device in the first compartment 105 remains in inaccessible, secure and concealed from view.

Additionally, to access the handheld device in the first compartment 105 the third attachment mechanism 135 of the second compartment 110 must be detached from the fourth attachment mechanism 122 of the front flap 120 and the first attachment mechanism 130 of the flexible portion 115 must be detached from the second attachment mechanism of the front flap 125. To perform the detachment of all four attachment mechanism of the apparatus the user pulls the front flap 120 in an upward direction toward the top opening of the second compartment 110 with sufficient force to detach the third attachment mechanism 135 from the fourth attachment mechanism 122 and to detach the first attachment mechanism 130 from the second attachment mechanism 125. In this way, the handheld device in the second compartment 110 is accessible to the user and the handheld device in the first compartment 105 is accessible to the user.

It is additionally envisioned that accessing the handheld device in the first compartment 105 may be performed by two separate applications of force by the user. In a first step the user may apply a first force on the front flap sufficient to detach the third attachment mechanism 135 from the fourth attachment mechanism 122, thereby exposing the handheld device in the second compartment 110. In a second step, subsequent to the first step, the user may then expose the handheld device in the first compartment 105 by applying a second force to the front flap to detach the first attachment mechanism 130 from the fourth attachment mechanism 125.

Figure 3:
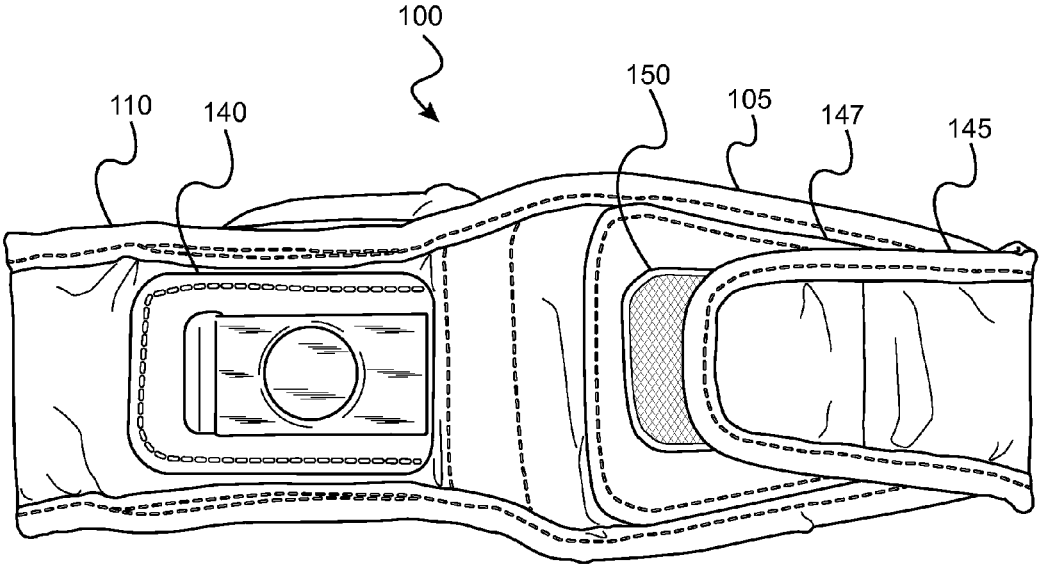
FIG. 3 is a diagram illustrating a back view of the apparatus for containing multiple handheld devices with the back flap in a closed position, in accordance with an embodiment of the present invention.
Figure 4:
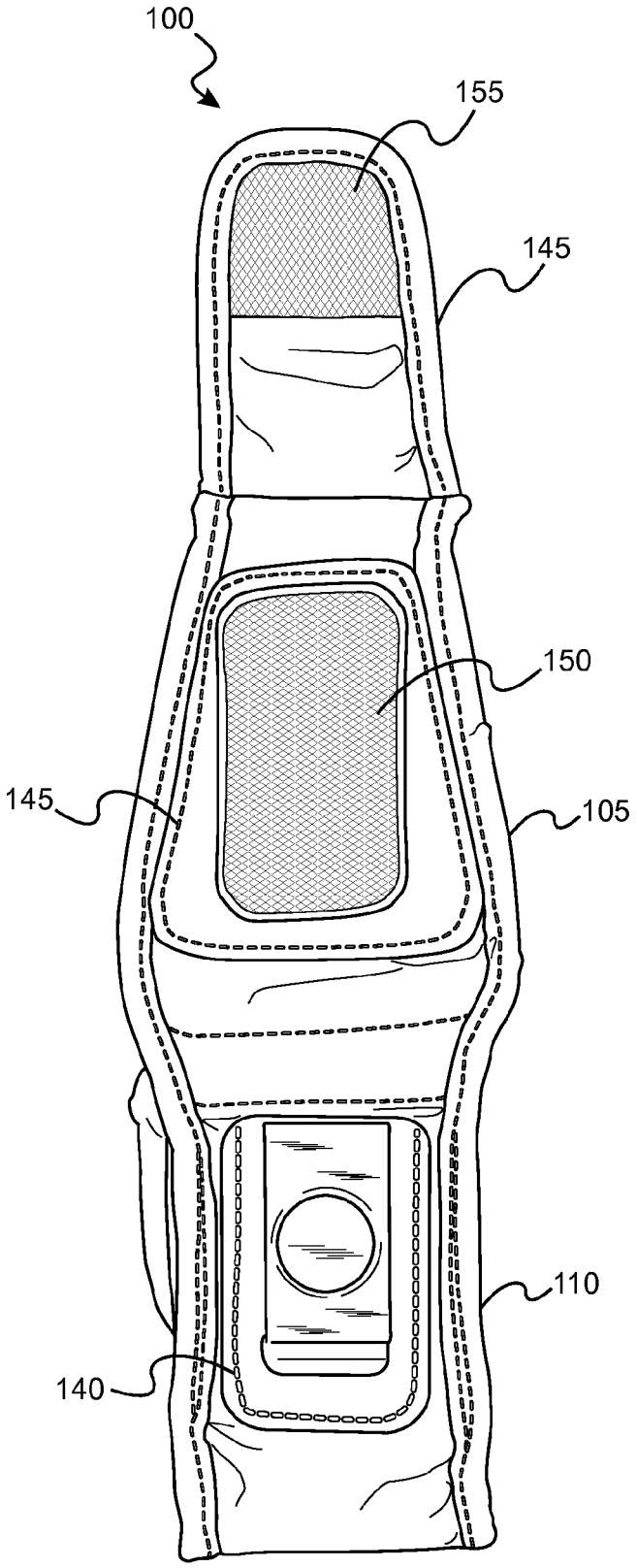
FIG. 4 is a diagram illustrating a back view of the apparatus for containing multiple handheld devices with the back flap in an open position, in accordance with an embodiment of the present invention.

As shown with reference to FIG. 3, to attach the apparatus 100 to a wearable article of the user, such as a belt, the apparatus further includes a first apparatus attachment device 147 positioned on the back portion of the first compartment 105 and configured to allow the apparatus to be attached to a wearable article. In one embodiment, the first apparatus attachment device 147 includes a back flap integral 145 with, and extending from, the front portion of the first compartment 105. As shown with reference to FIG. 4, the back flap 145 includes a sixth attachment mechanism 155 positioned on the side of the back flap 145 opposite the front portion of the first compartment 105. The apparatus 100 further includes a fifth attachment mechanism 150 positioned on the back portion of the first compartment 105. The back flap 145 in flexible and is configured to wrap around the first compartment 105, from the front of the first compartment 105 to the back of the first compartment 105, to form a bottom portion of the first compartment 105. The back flap 145 may be wrapped around the wearable article and the fifth attachment mechanism 150 may be removably attached to the sixth attachment mechanism 155 to attach the apparatus to the wearable article of the user.

In one embodiment, the fifth attachment mechanism 150 and the sixth attachment mechanism 155 may form a hook-and-loop fastener, more commonly known as Velcro®. In forming the hook-and-loop fastener, one of either the fifth attachment mechanism 150 or the sixth attachment mechanism 155 may be comprised of a plurality of plastic hooks and the other of the fifth attachment mechanism 150 or the sixth attachment mechanism 155 may be comprised of a plurality plastic loops, such that when the fifth attachment mechanism 150 and the sixth attachment mechanism 155 are in contact, they form a hook-and-loop fastener that secures the back flap 145 to the back of the first compartment 105. Alternatively, the fifth attachment mechanism 150 and the sixth attachment mechanism 155 may form a magnetic fastener or a physical fastener, such as a snap or latch, or any of a variety of other fastening means which are commonly known in the art.

In an additional embodiment, the first apparatus attachment device 147 may also be a belt clip or any of a variety of other devices known in the art capable of attaching an apparatus 100 to a wearable article.

As shown with reference FIG. 3, in an additional embodiment, to attach the apparatus 100 to a wearable article of the user, such as a belt, the apparatus 100 further includes a second apparatus attachment device 140 positioned on the back portion of the second compartment 110 and configured to allow the apparatus to be attached to a wearable article. In the figure shown, the apparatus attachment device 140 is a belt clip that is attachable to a belt worn by the user. However, in alternate embodiments, the apparatus device 140 may by any of a variety of other devices known in the art capable of attaching the apparatus 100 to wearable article.

Figure 5:
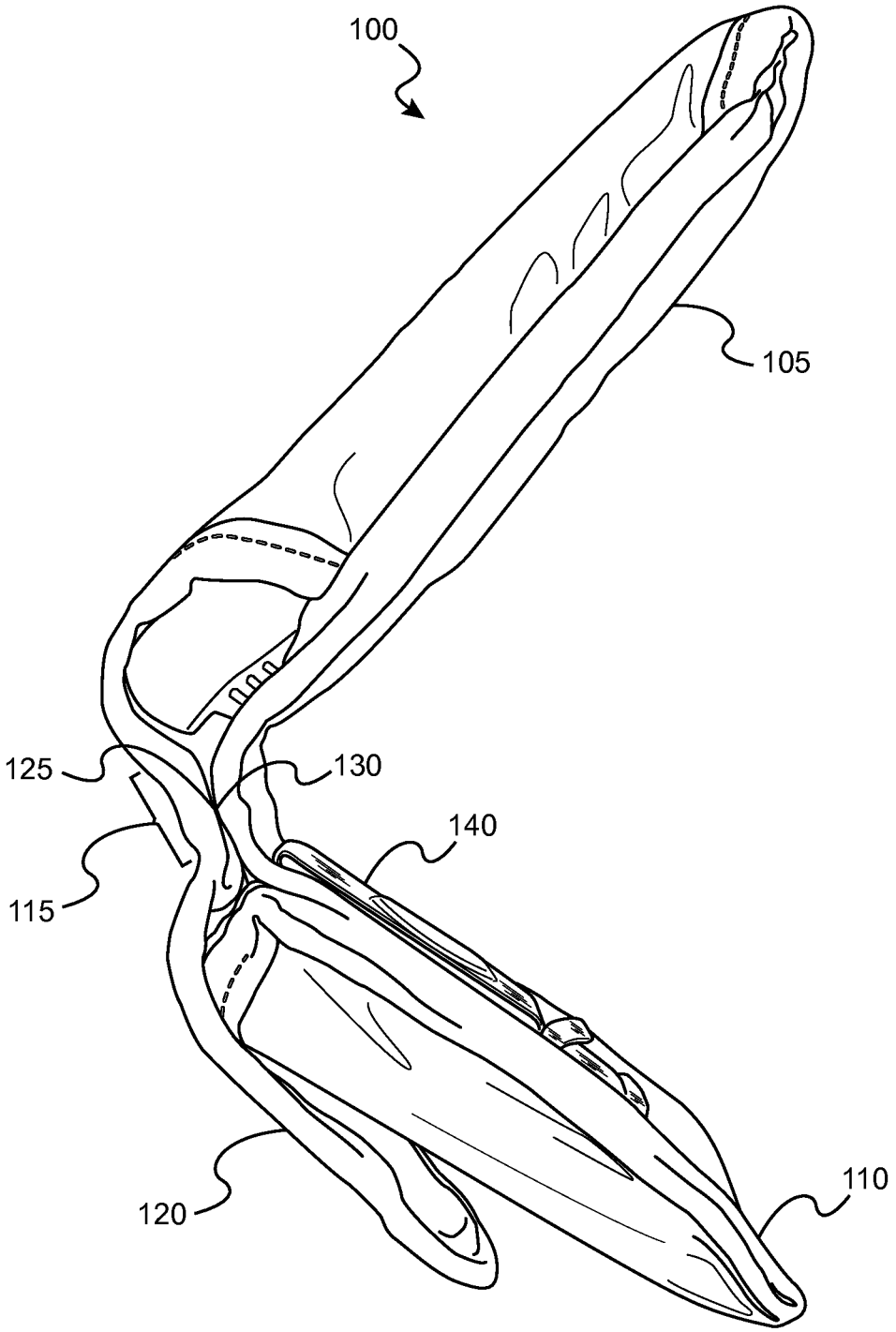
FIG. 5 is a diagram illustrating a side view of the apparatus for containing multiple handheld devices in accordance with an embodiment of the present invention.

An additional view of the apparatus 100 is illustrated with reference to FIG. 5. As shown in FIG. 5, the first compartment 105 is attached to the second compartment 110 by the flexible portion 115. In this view, the front flap 120 is in the closed position with the first attachment mechanism 130 in contact with the second attachment 125 and the third attachment mechanism 135 in contact with the fourth attachment mechanism 122. It can be seen that the flexible portion 115 effectively provides a hinge portion between the first compartment 105 and the second compartment. In this embodiment, the second compartment 110 includes a belt clip 140 for attaching to a belt worn by the user. Additionally, in this embodiment, the fifth attachment mechanism 150 and the sixth attachment mechanism 155 are not included with the apparatus 100.

Figure 6A:
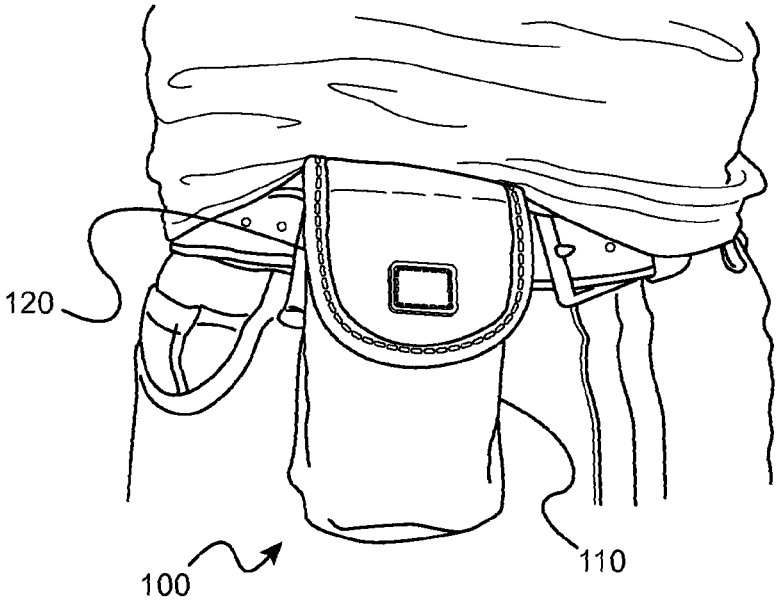
FIG. 6A is a diagram illustrating a front view of the apparatus for containing multiple handheld devices with the front flap in an open position and the apparatus attached to a user, in accordance with an embodiment of the present invention.
Figure 6B:
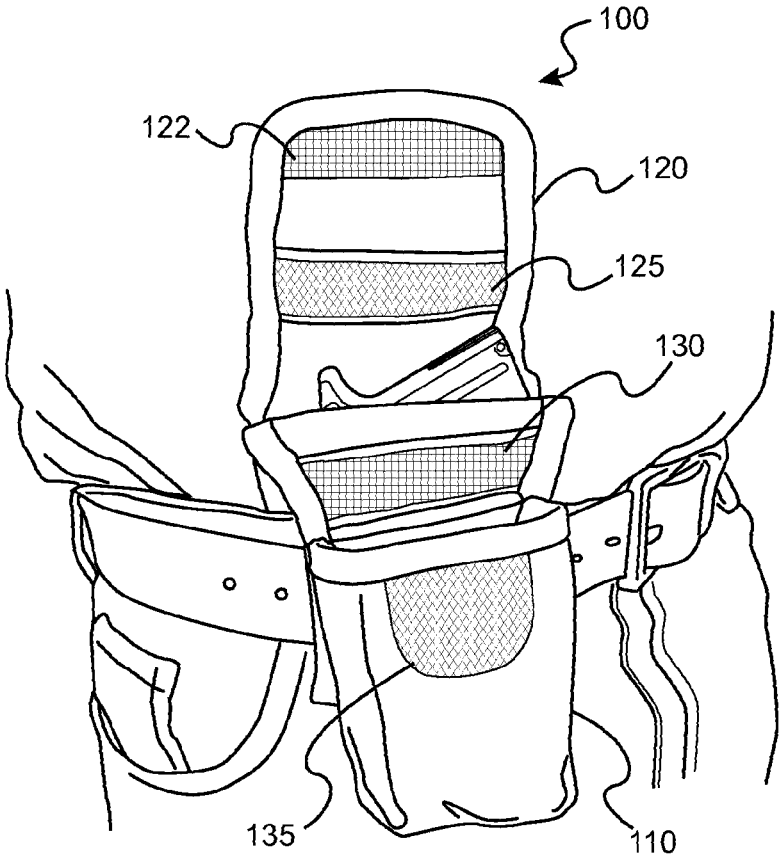
FIG. 6B is a diagram illustrating a front view of the apparatus for containing multiple handheld devices with the front flap in an open position and the apparatus attached to a user, in accordance with an embodiment of the present invention.

An illustration of the apparatus 100 in use is shown with reference to FIGS. 6A and 6B. As shown in FIG. 6A, the apparatus 100 is secured to a belt worn by the user. In this embodiment, the first compartment 105 is tucked within the waistband of the user, between the body of the user and the user's pants or other article of clothing. Additionally, in this embodiment, the front flap 120 is in a completely closed position to secure and conceal the openings of both the first compartment 105 and the second compartment. As such, in this embodiment, the first attachment mechanism 130 is attached to the second attachment mechanism 125 and the third attachment mechanism 135 is attached to the fourth attachment mechanism 122.

As shown in FIG. 6B, the apparatus 100 is secured to a belt worn by the user. In this embodiment, the first compartment 105 is tucked within the waistband of the user, between the body of the user and the user's pants or other article of clothing. Additionally, in this embodiment, the front flap 120 is in a completely open position to reveal and make accessible the openings of both the first compartment 105 and the second compartment. As such, in this embodiment, the first attachment mechanism 130 is detached from the second attachment mechanism 125 and the third attachment mechanism 135 is detached from the fourth attachment mechanism 122.

The apparatus of the present invention is capable of containing multiple handheld devices, such as a handheld firearm and a cellular telephone and is capable of being secured to a user by a common apparatus attachment device. The apparatus additionally provides independent accessibility to the multiple handheld devices.

The foregoing descriptions of specific embodiments of have been presented for purposes of illustration and description. They are not intended to be exhaustive or to limit the invention to the precise forms disclosed, and obviously many modifications and variations are possible in light of the above teaching. The embodiments were chosen and described in order to best explain the principles and practical applications, to thereby enable others skilled in the art to best utilize the various embodiments with various modifications as are suited to the particular use contemplated. It is intended that the scope be defined by the claims appended hereto and their equivalents.

The invention claimed is:

1. An apparatus for containing multiple handheld devices, the apparatus comprising:

a first compartment dimensioned to removably store a first device, the first compartment having opposing front and back portions, opposing side portions and a top portion opening to receive the first device;

a second compartment dimensioned to removably store a second device, the second compartment having a bottom portion, opposing front and back portions, opposing side portions and a top portion opening to receive the second device, wherein the back portion of the second compartment is attached to the back portion of the first compartment by a flexible portion attached near the opening of the first compartment and near the opening of the second compartment, and spanning a distance between the first compartment and the second compartment, the flexible portion including a first attachment mechanism positioned between the first compartment and the second compartment; and a front flap non-removably attached at the front portion of the first compartment, the front flap to removably overlap the opening of the first compartment and the opening of the second compartment and the front flap including a second attachment mechanism to removably attach to the first attachment mechanism of the flexible portion.

2. The apparatus of claim 1, further comprising a third attachment mechanism positioned on the front portion of the second compartment and wherein the front flap further comprises a fourth attachment mechanism to removably attach the front flap to the front portion of the second compartment.

3. The apparatus of claim 1, wherein the first device is a handheld firearm.

4. The apparatus of claim 1, wherein the second device is a portable communication device.

5. The apparatus of claim 1, further comprising a first apparatus attachment device positioned on the back portion of the first compartment and configured to allow the apparatus to be attached to a wearable article.

6. The apparatus of claim 5, wherein the wearable article is a belt.

7. The apparatus of claim 5, wherein the first compartment further comprises a fifth attachment mechanism positioned on the back portion of the first compartment and the first apparatus attachment device comprising a back flap integral with, and extending from, the front portion of the first compartment, the back flap to form a bottom portion of the first compartment and the back flap having a sixth attachment mechanism to removably attach the back flap to the third attachment mechanism of the first compartment.

8. The apparatus of claim 1, further comprising a second apparatus attachment device positioned on the back portion of the second compartment and configured to allow the apparatus to be attached to a wearable article.

9. The apparatus of claim 8, wherein the wearable article is a belt.

10. The apparatus of claim 8, wherein the second apparatus attachment device is a belt clip.

11. The apparatus of claim 1, wherein the first attachment mechanism and the second attachment mechanism form a hook-and-loop fastener.

12. The apparatus of claim 7, wherein the third attachment mechanism and the fourth attachment mechanism form a hook-and-loop fastener.

13. The apparatus of claim 10, wherein the fifth attachment mechanism and the sixth attachment mechanism form a hook-and-loop fastener.

14. An apparatus for containing multiple handheld devices, the apparatus comprising:

a first compartment dimensioned to removably store a first device, the first compartment having a bottom portion, opposing front and back portions, opposing side portions and a top portion opening to receive the first device;

a second compartment dimensioned to removably store a second device, the second compartment having a bottom portion, opposing front and back portions, opposing side portions, a top portion opening to receive the second device and a third attachment mechanism positioned on the front portion of the second compartment, wherein the back portion of the second compartment is attached to the back portion of the first compartment by a flexible portion attached near the opening of the first compartment and near the opening of the second compartment, and spanning a distance between the first compartment and the second compartment, the flexible portion including a first attachment mechanism positioned between the first compartment and the second compartment; and a front flap non-removably attached at the front portion of the first compartment, the front flap to removably overlap the opening of the first compartment and the opening of the second compartment and the front flap including a second attachment mechanism to removably attach to the first attachment mechanism of the flexible portion and a fourth attachment mechanism to removably attach to the third attachment mechanism of the second compartment.

15. The apparatus of claim 14, wherein the first device is a handheld firearm and the second device is a portable communication device.

16. The apparatus of claim 14, wherein the apparatus further comprises a belt clip positioned on the back portion of the second compartment.

17. The apparatus of claim 14, wherein the first attachment mechanism and the second attachment mechanism form a hook-and-loop fastener and the fifth attachment mechanism and the sixth attachment mechanism form a hook-and-loop fastener.

18. An apparatus for containing multiple handheld devices, the apparatus comprising:

a first compartment dimensioned to removably store a first device, the first compartment having opposing front and back portions, opposing side portions, a top portion opening to receive the first device and a fifth attachment mechanism positioned on the back portion of the first compartment;

a second compartment dimensioned to removably store a second device, the second compartment having a bottom portion, opposing front and back portions, opposing side portions, a top portion opening to receive the second device and a third attachment mechanism positioned on the front portion of the second compartment, wherein the back portion of the second compartment is attached to the back portion of the first compartment by a flexible portion spanning a distance between the first compartment and the second compartment, the flexible portion including a first attachment mechanism positioned between the first compartment and the second compartment;

a front flap extending from the front portion of the first compartment, the front flap to removably overlap the opening of the first compartment and the opening of the second compartment and the front flap including a second attachment mechanism to removably attach to the first attachment mechanism of the flexible portion and a fourth attachment mechanism to removably attach to the third attachment mechanism of the second compartment; and a first apparatus attachment device comprising a back flap integral with, and extending from, the front portion of the first compartment, the back flap to form a bottom portion of the first compartment and the back flap having a sixth attachment mechanism to removably attach the back flap to the fifth attachment mechanism of the first compartment.

19. The apparatus of claim 18, wherein the first device is a handheld firearm and the second device is a portable communication device.

20. The apparatus of claim 18, wherein the apparatus further comprises a belt clip positioned on the back portion of the second compartment.

* * * * *